United States Patent [19]

Frederick et al.

[11] 4,119,220

[45] Oct. 10, 1978

[54] SHEET FEEDING APPARATUS

[75] Inventors: Louis J. Frederick, Fairmount; Kenneth E. Hoke, Marion; Jerrold W. Greene, Marion; Stephen D. Miller, Marion, all of Ind.

[73] Assignee: Greene Line Manufacturing Corp., Marion, Ind.

[21] Appl. No.: 771,456

[22] Filed: Feb. 24, 1977

[51] Int. Cl.[2] ..... B65H 1/22

[52] U.S. Cl. ..... 214/8.5 A; 198/373; 271/1 Q; 271/1 S; 214/8.5 G; 214/151; 214/201

[58] Field of Search ..... 214/8.5 R, 55, 8.5 A, 214/314, 8.5 G, 1 R, 1 S, 130 R, 130 C, 1 Q, 6 C; 198/406, 410, 373; 271/3.1, 199, 200, 201, 265, 270, 149, 150, 151, 35, 165

[56] References Cited

U.S. PATENT DOCUMENTS

| | | | |
|---|---|---|---|
| 2,642,221 | 6/1953 | Offutt et al. | 271/201 X |
| 2,707,568 | 5/1955 | Jackson | 214/8.5 R |
| 2,863,571 | 12/1958 | Foley et al. | 214/130 R X |
| 3,190,472 | 6/1965 | Nash et al. | 214/55 X |
| 3,458,070 | 7/1969 | Moore et al. | 214/314 X |
| 3,982,750 | 9/1976 | Pulda | 214/8.5 A X |
| 4,013,177 | 3/1977 | Kinnicutt, Jr. et al. | 214/130 C X |

FOREIGN PATENT DOCUMENTS

| | | | |
|---|---|---|---|
| 436,431 | 11/1926 | Fed. Rep. of Germany | 214/55 |

*Primary Examiner*—Frank E. Werner

*Attorney, Agent, or Firm*—Woodard, Weikart, Emhardt & Naughton

[57] ABSTRACT

Disclosed is a sheet feeding apparatus in which the stack of sheets forming the load are fed onto a pivoting cradle whose pivot axis is at a height permitting substantially horizontal delivery of the sheets to the receiving conveyor. After each loading of the cradle, it is moved horizontally toward the receiving conveyor an amount sufficient to cover any feeding gap on the conveyor caused by the excursion of the cradle through its load position.

10 Claims, 10 Drawing Figures

SHEET FEEDING APPARATUS

BACKGROUND OF THE INVENTION

Sheet feeding apparatus of the general type herein disclosed has become widely used in the corrugated container industry and heavy manual labor has thus been eliminated at various points throughout the typical box plant. Such automatic feeding apparatus is utilized in the feeding of printer-slotters, die cutters, folder-gluers and the like. A patent disclosing apparatus of this type is Hoke et al. U.S. pat. No. 3,815,762.

Where the press hopper or other apparatus is being fed by a feed transfer conveyor which presents the sheets sequentially, in "shingled" or overlapping form, to the apparatus, the reloading cycle of the sheet feeding apparatus presents difficulties. Since the feeder cradle must be loaded in stack-size increments, in the time interval between feeding of the last sheet from the cradle and the feeding of the initial sheets from the reloaded cradle (the time necessary for the cradle to move through its reloading cycle) a gap is created in the shingle or series flow of sheets on the feed transfer conveyor. The apparatus of the present invention overcomes this difficulty by moving the cradle horizontally, after each reloading of the cradle, toward the receiving conveyor an amount sufficient to cover the feeding gap caused by the excursion of the cradle through its load position. Elimination of this gap in the shingle or sequence feeding the press between cradle loadings makes unnecessary the intermittant stoppage of the press for feeder reloading, a characteristic of prior art feeding apparatus.

This capability for horizontal motion of the cradle is also utilized during momentary stoppages of the press or other apparatus being fed. If, during feeding or "shingling" of sheets from the cradle to the receiving conveyor the receiving conveyor should stop, because the press hopper is full, for example, the cradle will continue feeding sheets but will retreat, horizontally, away from the receiving conveyor. Since the dispensing tip of the cradle overlies the receiving conveyor, sheets will be deposited along the momentarily stationary, receiving conveyor. The feed sequence is thus unbroken upon momentary receiving conveyor stoppages. When the conveyor restarts, the cradle will halt its retreating, horizontal motion and continue feeding sheets to the now-moving receiving conveyor. If the receiving conveyor again halts, the cradle will continue its retreat until a predetermined home position is reached. When emptied, and in this home position, the cradle will immediately go through its reloading cycle and then advance forward on the receiving conveyor to its advanced position and begin feeding sheets from its newly loaded stack.

The apparatus of the present invention is further characterized by a generally L-shaped cradle which receives a stack load between shaped members forming its upright leg. Load support members are then moved to a position between the spaced leg members and support the tipped stack when the cradle is pivoted into feeding position. The pivotal axis of the cradle is at a level such that when the cradle has been moved to feed position and the included angle between the cradle legs has been increased from 90° to approximately 180°, the sheets will be fed from the cradle substantially horizontally onto the receiving conveyor. The up-hill feed characteristic of conventional feed apparatus is thus eliminated.

Description of the Preferred Embodiment

Figure 1:
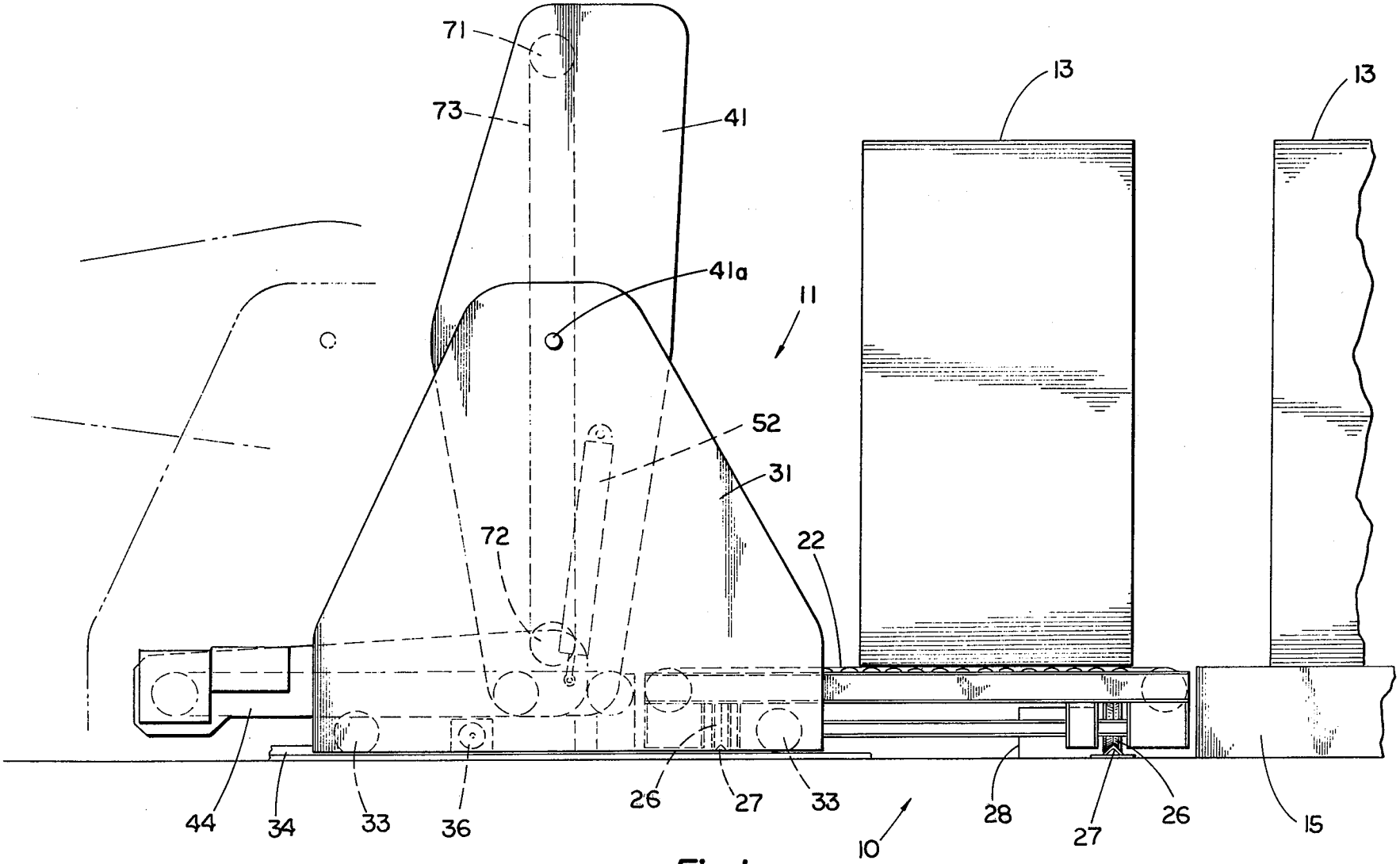
FIG. 1 is a side view of the cradle component of the apparatus in load position with subsequent positions of the cradle being shown in broken lines.
Figure 3:
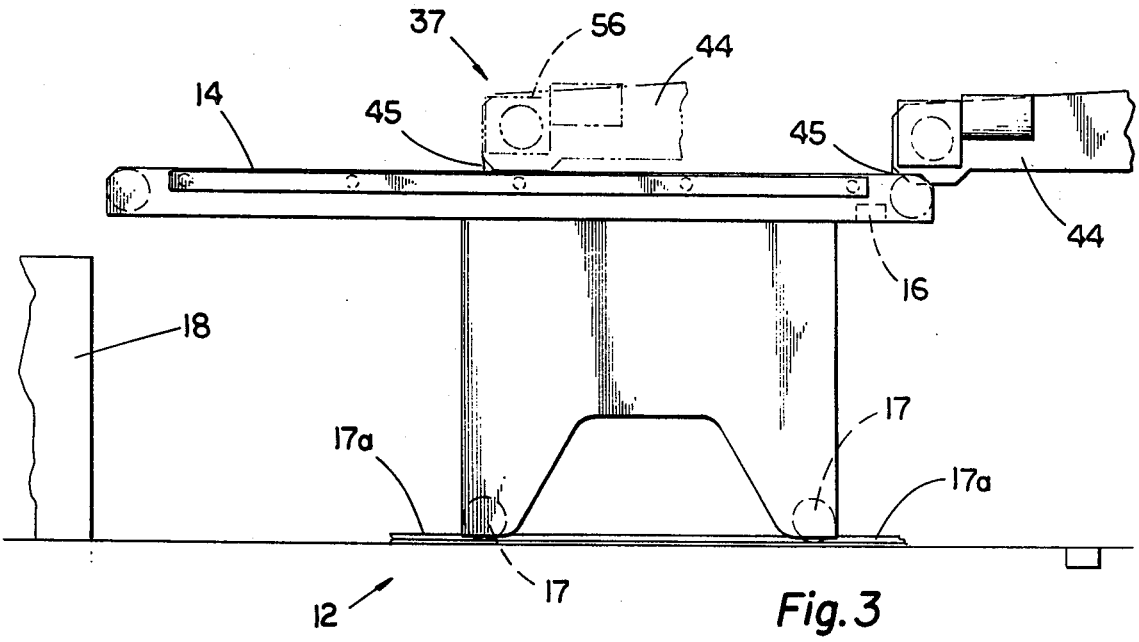
FIG. 3 is a side view of the receiving conveyor component of the apparatus and showing a portion of the cradle in feed position.

Referring initially to FIG. 1 and 3, it will be evident that the apparatus has three components: A support means or load-centering section 10, a cradle indicated generally at 11 and a receiving or transfer conveyor 12. The centering section 10 receives a stack 13 of corrugated board sheets to be printed or otherwise processed from a storage conveyor, indicated at 15, having a conventional automatic feed and not a part of the present invention.

The receiving conveyor 12 is formed by a belt-over-roller powered conveyor 14, driven by a variable speed drive motor 16 (FIG. 3), the conveyor being supported by a frame carrying wheels 17 which may travel along a track 17*a*. The delivery end of the conveyor 14 is adjacent a press hopper fragmentarily shown at 18 in FIG. 3 which receives the sheets flowing from the conveyor when it is in operation. Conventionally, a control is exerted on the conveyor drive motor 16 such that it halts the conveyor when the hopper 18 is full. The receiving conveyor is movable toward and away from the hopper and press to permit access to the press for set-up and to accommodate running sheets lots of differing dimensions. Also aiding in the accommodation of variously sized stacks are the movable sheet carrying runners 21 which can be moved outwardly or inwardly, as desired, on telescoping support rods. It is understood that runners 21 are not necessary to the practice of the instant invention. The variable speed drive for the conveyor 14 permits the thickness of the "shingle" or beveled, overlapping pile of sheets on the conveyor to be adjusted.

The centering conveyor 10 includes a powered, belt-over-roller conveyor 22, driven by a motor 23 (FIG. 2), or similar drive means. The conveyor 22 is carried on a frame provided with grooved wheels 26 (FIG. 1) which travel on transverse, parallel tracks 27. A drive motor such as motor 28, (FIG. 1) may be utilized to adjust the position of the stack 13 by moving the conveyor transversely on tracks 27 as required to center the conveyor 22, and hence the stack for loading into cradle 11.

Figure 7:
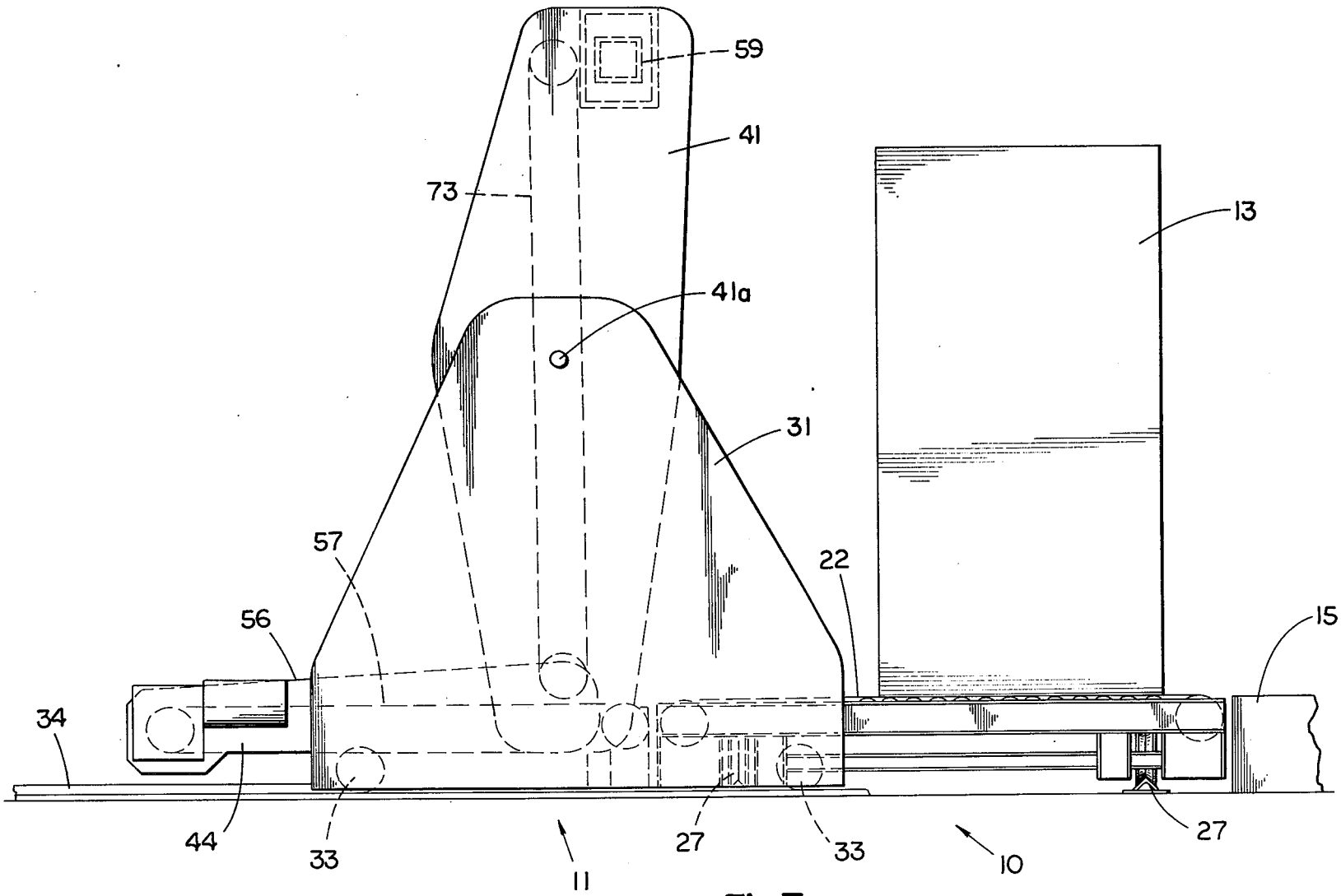
FIG. 7 is a side view of the cradle component in load position, with obscuring portions of the drive mechanism omitted.

The cradle, or pivoting feed conveyor, 11 includes supporting elements including stanchions 31 and 32 (FIG. 2), upon which the L-shaped cradle structure proper, to be subsequently described, is pivotally supported. The stanchions are supported on wheels 33 (FIG. 1) which ride on tracks 34 shown fragmentarily in FIG. 1 and more extensively in FIG. 7. Horizontal motion of the stanchions, and the structure they support is accomplished by a chain drive from the motor 36 (FIG. 1) to a sprocket rotationally locked to the front of leftward (as viewed in FIG. 1) wheels 33 on the two stanchions. The cradle stanchions and the cradle structure during the operational sequence are moved, horizontally, on tracks 34 from a load position, shown in solid lines in FIG. 1 and 7, to an intermediate position, shown fragmentarily in broken lines in FIG. 1 and in solid lines in FIG. 8 and, finally, to a feed position, shown fragmentarily in broken lines identified at 37 in FIG. 3, this position being leftwardly beyond the intermediate position of FIG. 1 and 10 and, in this position, the delivery tip of the conveyor overlaps the receiving conveyor 14.

As previously mentioned, the cradle structure proper is generally L-shaped and is formed by a duplicate set of horizontal legs 44 and 46, transverse plate 47 spanning the legs 44 and 46. It will be understood that while only legs 41 and 44 are visible in the various side views in the drawings, the opposite counterparts 42 and 46 of these legs move in unison with them.

Figure 5:
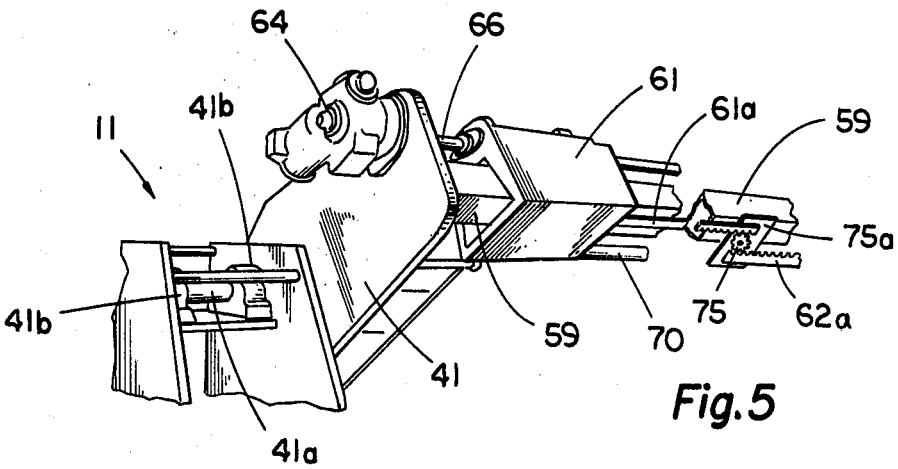
FIG. 5 is a fragmentary, perspective view of the cradle component and one of its supporting stanchions.

Intermediate the ends of legs 41 and 42 stub-shafts **41*a* and 42*a* extend outwardly from the respective legs and are journaled in bearings 41*b* (FIG. 5). As will be evident, particularly in FIG. 5, the stanchions are formed by spaced steel plates, properly braced transversely, and enclosing a motor 51 (FIG. 2) connected by a suitable transmission to the shaft 41*a* for pivotally moving the L-shaped cradle about the pivotal axis defined by shafts 41*a* and 42*a*. It will be understood that a hydraulic cylinder, properly mounted, might also be used, in place of motor 51, to pivotally move the cradle. As indicated in FIG. 1, the set of legs 41 and 42 extend upwardly at approximately 90° to the horizontal set of legs 44 and 46 but, by means of the hydraulic cylinder 52 (FIG. 1), these legs may be angularly moved (about pivot 43**) with relation to each other so as to vary the included angle between them.

Figure 2:
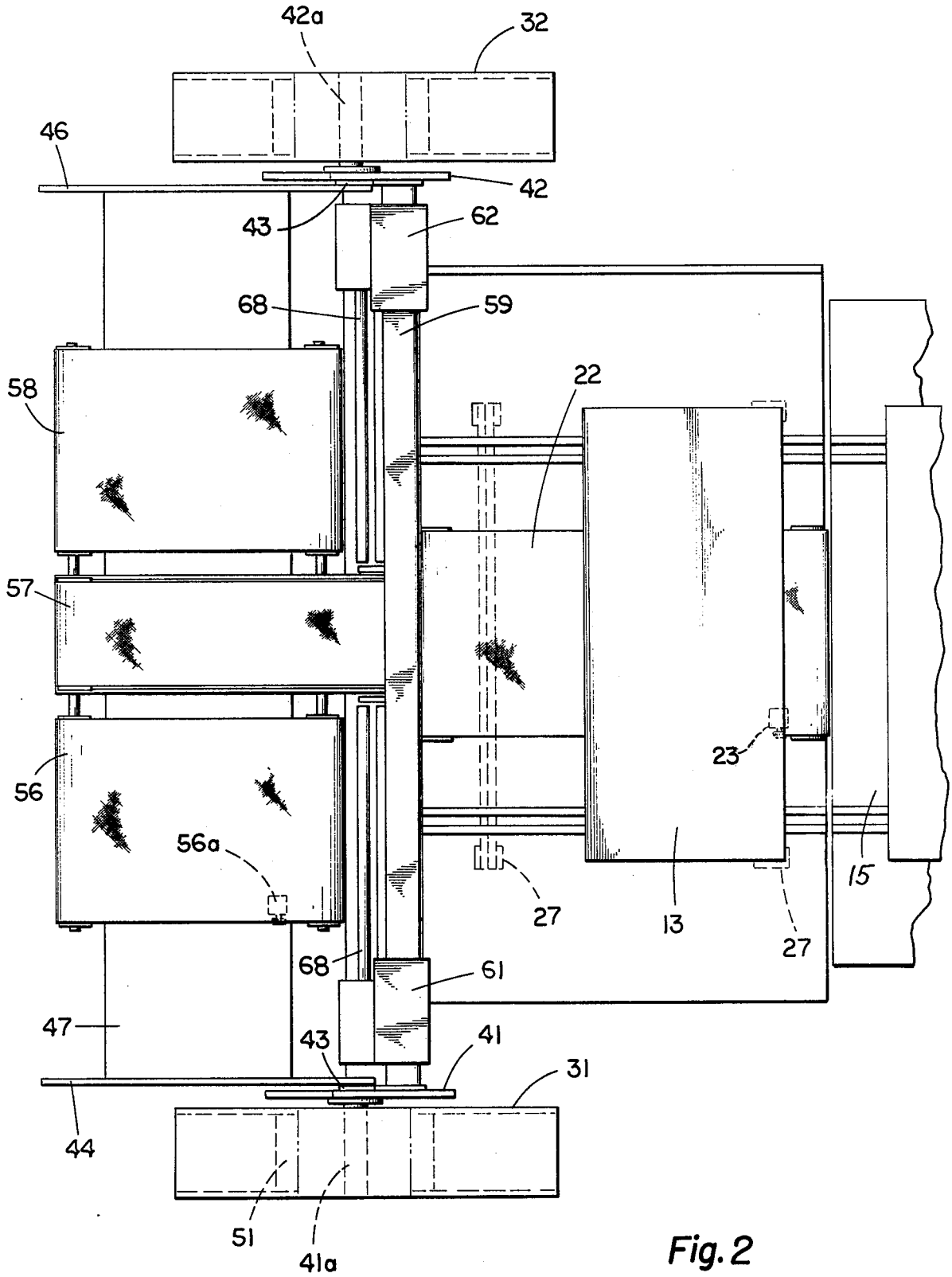
FIG. 2 is a top plan view of the structure shown in FIG. 1.
Figure 6:
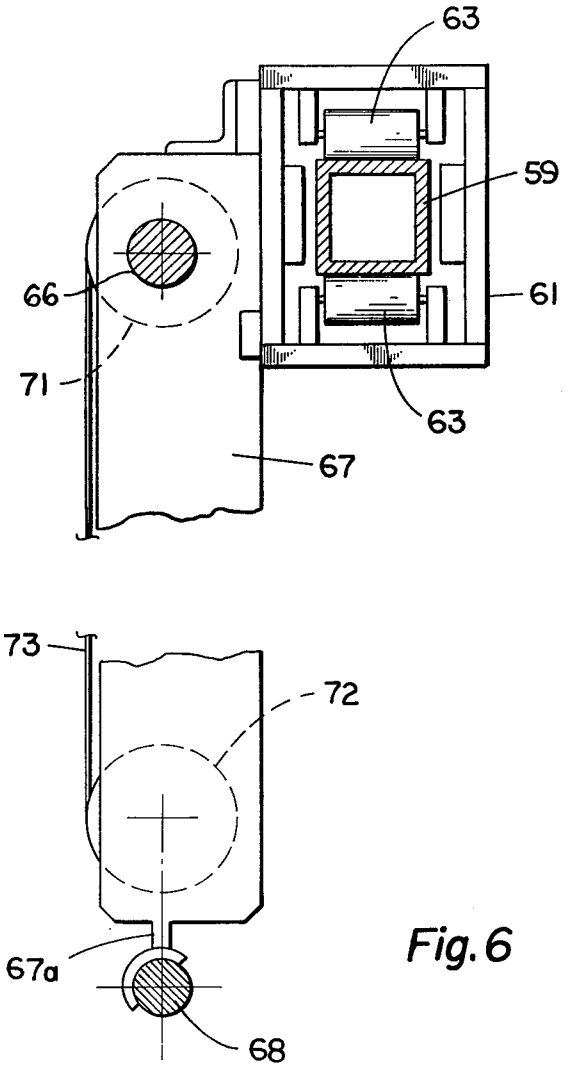
FIG. 6 is an enlarged, fragmentary, side sectional view of the transport mechanism for the load support structure on the cradle.

The horizontal legs 44 and 46 carry, between them, three belt-over-roller conveyors identified at 56, 57 and 58 in FIG. 2 and driven, in unison, by drive motor **56*a*. A sensing element including flexible fingers 45 (FIG. 3) carried at the tip of members 44 and 46 functions to sense the trailing edge of the material already on the receiving conveyor 12. Extending between the vertical legs 41 and 42, and secured to them is a guide tube 59 (FIG. 6). Riding on the guide tube are two rectangular guide housings 61 and 62 (FIG. 2), one of which (61) is shown in FIG. 5 and in cross-sectional detail in FIG. 6. As may be seen in FIG. 6, the housings carry internal rollers 63 which engage the tube 59** permitting the housings to slide smoothly along the tube.

The drive means for moving the housings from their outboard positions of FIG. 2 and 5 toward the center of the structure is shown in FIG. 5. A suitable motor and reduction gearing 64 rotate transverse shaft 66 which drives conveyor belts 73 to be subsequently referred to with reference to FIG. 6. A hydraulic cylinder 70 extends between, and has its opposite ends secured to, the guide tube 59 and guide housing 62 (FIG. 2). Movement of the thrust rod of the hydraulic cylinder moves the housings 61 and 62 toward each other, that is, toward the center of the structure so that they assume a position in which they are centered on the width of conveyors 56 and 58, as viewed in FIG. 2. A rack and pinion assembly stabilizes and insures synchronization of the relative motion of the housings 61 and 62. This assembly includes toothed rack members **61*a* and 62*a* which extend horizontally from the housings 61 and 62, respectively, and mesh with an idler gear 75 journalled on a stub-shaft carried by a plate 75*a* secured to the tube 59** at its midpoint.

As may best be seen in FIG. 6, the housings 61 and 62 each carry spaced, load-support bars or plates 67 which depend from the housings and are braced at their base by arcuate foot portions **67*a* which overlie and ride along the transverse guide rods 68 which extend inwardly, axially aligned, from the legs 44 and 46. The plates 67, a pair of which are carried by each of the housings 61 and 62, support transverse rollers 71 and 72 over which is driven a conveyor belt 73. Each of the movable housings 61 and 62 carries a conveyor belt 73, the drive for the rollers being provided by the motor 64 (FIG. 5) which rotates shaft 66, the drive shaft for the transverse rollers. As will be evident from FIG. 2, with the housings 61 and 62 in their outer or load clearance position, conveyor 22 may move the stack of sheets 13 under the tube 59, through the unobstructed space between the housings 61 and 62 and on the conveyors 56, 57 and 58. Subsequently, the housings 61 and 62, with their load support plates 67 and conveyors 73, may be moved inwardly to back the stack as it stands erect on the conveyors 56, 57 and 58**.

FIGS. 7–10 illustrate the operational sequence of the apparatus. In operation, referring initially to FIG. 7, the storage conveyor line 15, not part of the present invention, automatically delivers a stack 13 of corrugated sheets to centering section 10 whenever it is vacant. In the centering section the position of the stack may be shifted transversely on tracks 27 to center the stack between the upright members 41 and 42 of the L-shaped cradle 11. The conveyor 22 of the centering component 10 may then be operated to insert the stack onto the conveyors 56, 57 and 58 (conveyors 56, 57 and 58 operating in conjunction with conveyor 22 to complete this movement of the stack), the stack moving between members 41 and 42 and beneath guide tube 59. Once the stack has cleared the centering section 10, this component may be returned to a physically centered position with respect to the cradle for receiving the next stack.

Figure 8:
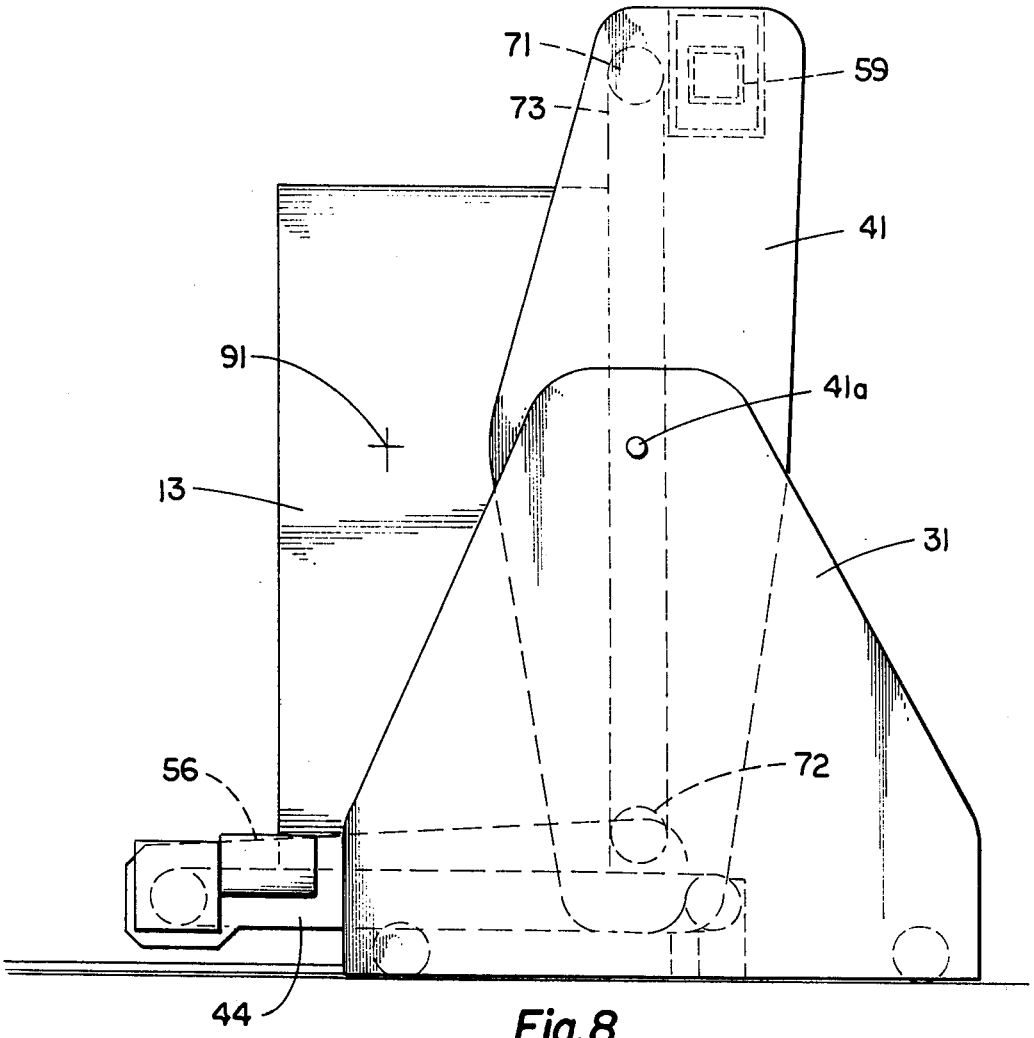
FIG. 8 is a view similar to FIG. 7 but showing a corrugated sheet stack loaded on the cradle.

After the stack has reached the position shown in FIG. 8, the cradle 11 will advance leftwardly along tracks 34 until the pivot axis **41*a* reaches the position indicated at 91 in FIG. 8. This intermediate position of the cradle stanchions 31 and 32 is illustrated in solid lines in FIG. 9 with the initial position of the stanchions and cradle (the position of FIG. 8) being indicated by broken lines at 92**.

During this leftward travel of the cradle, the housings 61 and 62 will be moved by their drive means 70 (FIG. 5) toward the transverse center of the cradle bringing load-support plates 67, and the conveyors 73 carried between them, into a position in which they back the rear vertical surface of the load, the housings 61 and 62 moving into this load-backing position from their widely separate, load clearing position of FIG. 2.

Figure 9:
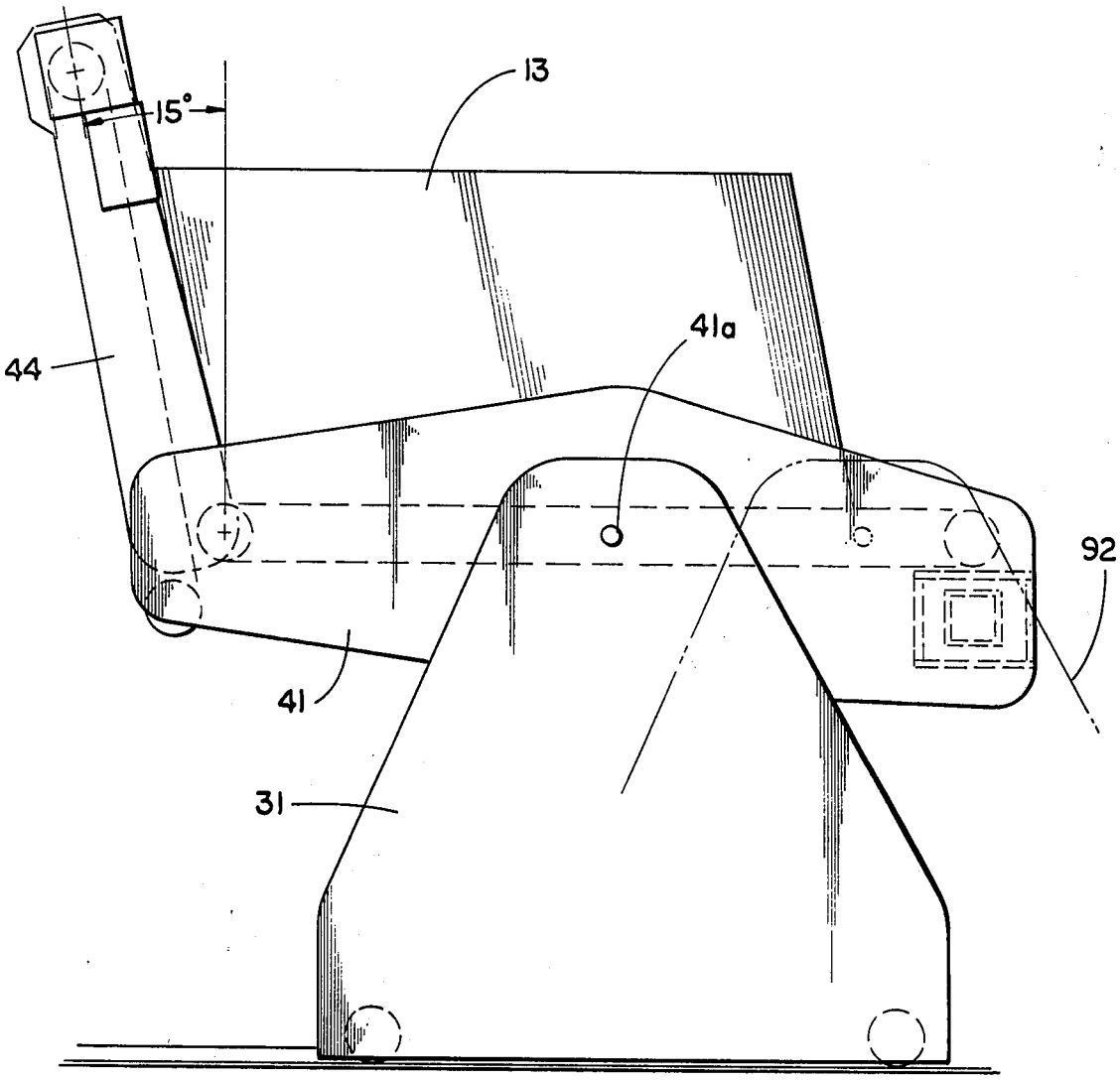
FIG. 9 is a view similar to FIG. 8 but showing the cradle in its motion from load to feed positions.

After the cradle arrives at its position of FIG. 8 and the housings 61 and 62 have assumed their position backing the load or stack 13, the cradle will pivot 90° about pivot axis 41*a*, placing legs 41 and 42 in horizontal position, as shown in FIG. 9. As this pivotal motion of the cradle is being completed the members 44 and 46 of the cradle will pivotally move to increase the included angle between the legs of the cradle by approximately 15°, this motion being indicated in FIG. 9. As shown in FIG. 9, the stack 13 will now be supported, on its side, by the conveyors 56, 57 and 58 located between cradle members 41 and 42 with the stack tilted or committed toward the cradle members 44 and 46.

Figure 10:
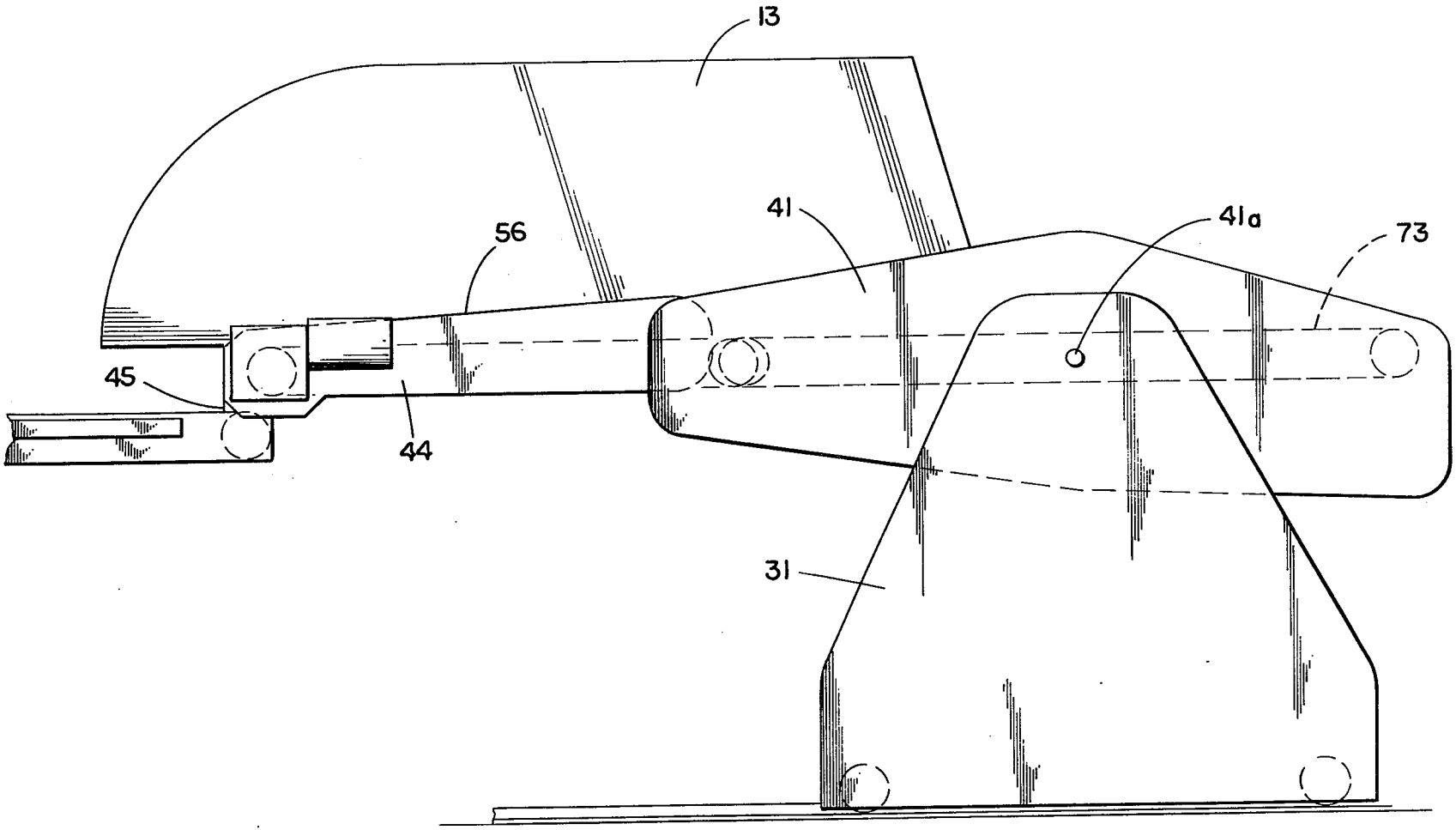
FIG. 10 is a view similar to FIG. 9 but showing the cradle after it has reached feed position.

After the position of FIG. 9 is reached, the members 44 and 46 will pivotally move further until they are in substantially horizontal alignment with the members 41 and 42, this position being shown in FIG. 10. As there indicated, the stack 13 assumes a leftwardly bevelled condition ready to be shingled or delivered off the cradle by operation of the conveyors carried by the now horizontally aligned cradle legs.

Figure 4:
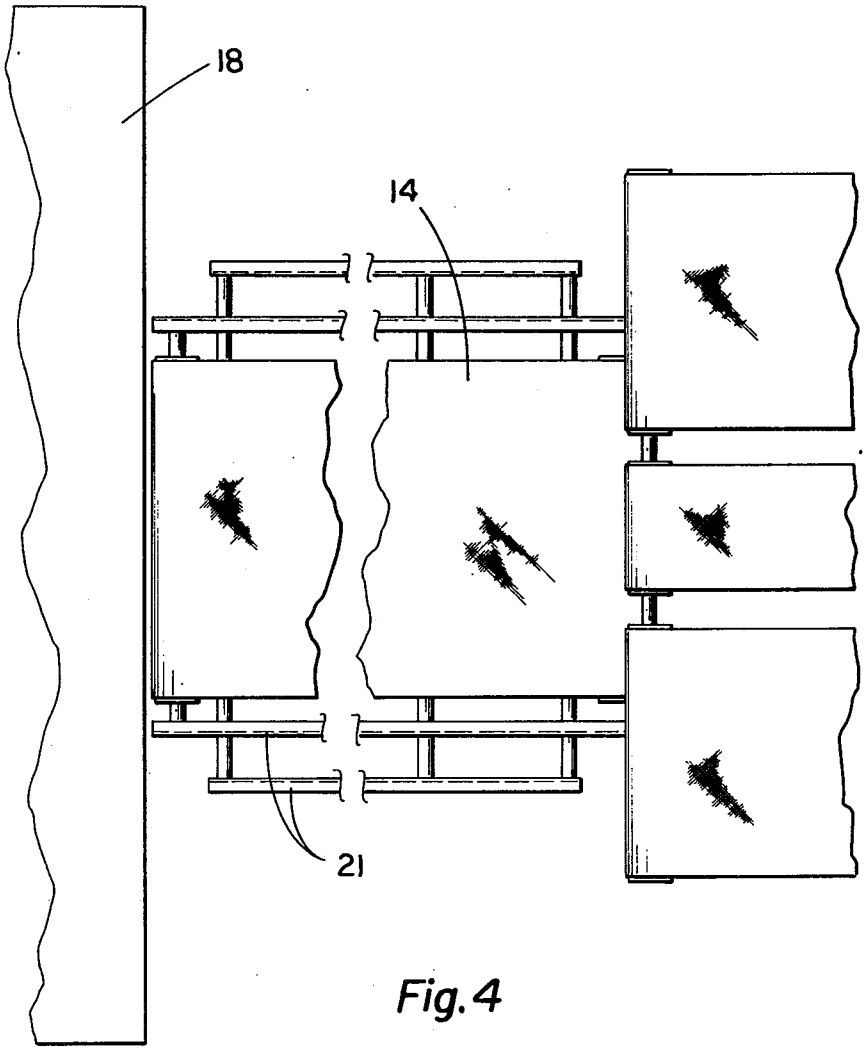
FIG. 4 is a top plan view of the structure shown in FIG. 3.

The cradle now advances leftwardly, as viewed in FIG. 10, over the powered conveyor 14 carried by the feed transfer conveyor component 12 into a feed position as shown in broken lines at 37 in FIG. 3. The leftward motion of the legs 44 and 46 and the cradle may be stopped intermediate its solid line position of FIG. 3 (and FIG. 10) and the broken line position indicated at 37 by the sensing fingers 45 (FIG. 3) engaging the trailing edge of the preceding material on the conveyor 14. The conveyors carried by the horizontally aligned cradle leg portions will now operate to flow material from the stack onto conveyor 14. Delivery of material will continue as long as conveyor 14 is running. Should conveyor 14 stop, due to the press hopper 18 (FIG. 4) being full, for example, the cradle will continue to deliver material from the stack and will travel rightwardly, as viewed in FIG. 1 toward its intermediate, or home feed, position of FIG. 10. If the conveyor 14 restarts before the cradle reaches this home position, the cradle will halt its rightward movement and continue feeding material onto conveyor 14. This action prevents gaps in the material on conveyor 14 caused by short stop intervals in the action of conveyor 14.

After the cradle has been emptied, it will retreat to its home position of FIG. 10 (assuming it is not already in this position when the stack is depleted). Thereupon the cradle will move in reverse sequence through its position of FIG. 9, the stanchions 31 and 32 moving rightwardly to shift the cradle to its load position indicated at 92 in FIG. 9 and shown in solid lines FIG. 8. The housings 61 and 62 and the load support plates 67 carried by them will be moved outwardly to their positions of FIG. 2, clearing the cradle for receiving another stack from conveyor 22. The cycle is then repeated and the delivery end of the members 44 and 46 will advance over conveyor 14 until fingers 45 sense the trailing edge of the material from the preceding stack. The cradle is thus moved horizontally an amount sufficient to cover any feeding gap on the receiving conveyor caused by the excursion of the cradle back through its load position (FIG. 7) for reloading.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Apparatus for feeding sheets to a receiving conveyor from a stack comprising: support means for centering and supporting the stack in upright position, a cradle for the stack formed by spaced, generally L-shaped members, the legs of the respective members being pivotally movable at their junction to vary the included angle, motor means for producing such pivotal movement, spaced stanchion members for pivotally supporting said cradle on a horizontal pivotal axis intermediate the ends of one set of the legs of the L-shaped members, means for pivoting the cradle about said axis between a load position in which said one set of the legs is substantially vertical and the other is substantially horizontal and a feed position in which both sets of legs are substantially horizontal, conveyor means carried by said support means and said cradle for delivering the stack upright into the cradle in its said load position and for delivering sheets off the free end of said other set of legs when the cradle is in said feed position, said stanchion members being adapted for horizontal motion in the direction of feed of the sheets from the conveyor means, and power means operable each time said cradle reaches feed position to advance said stanchion members, and thus said cradle, in the direction of feed of the sheets an amount sufficient to cover any feeding gap on the receiving conveyor caused by the excursion of the cradle through its load position for reloading.

2. Apparatus as claimed in claim 1 in which said power means is operable to move said stanchion members, and hence said cradle, a predetermined amount prior to movement of said cradle from its load to its feed position, said predetermined amount being sufficient to clear said support means for receipt of the next stack as the cradle moves between said positions.

3. Apparatus as claimed in claim 1 in which said power means is operable to move said stanchion members, and hence said cradle, reversely against the direction of feed when the receiving conveyor is halted.

4. Apparatus as claimed in claim 1 in which sensing means is carried by said cradle which, when the cradle is in feed position, senses the position of the trailing margin of the last sheet previously deposited on the receiving conveyor, and thereby determining the amount of advancement of the stanchion members and cradle necessary to cover said feeding gap on the receiving conveyor.

5. Apparatus as claimed in claim 1 in which said motor means increases said included angle between said legs by an increment of the order of 15° as said cradle is moved out of said load position and prior to said cradle reaching said feed position.

6. Apparatus as claimed in claim 1 having load support members laterally inserted adjacent the stack after the stack has been delivered upright into the cradle and before the cradle moves beyond said load position.

7. Apparatus as claimed in claim 6 in which said load support members are generally parallel to and coextensive with said one set of the legs of the L-shaped members forming said cradle.

8. Apparatus as claimed in claim 1 in which said horizontal pivotal axis of the cradle is at substantially the same vertical level as the receiving conveyor so that sheets are fed substantially horizontally from said cradle in feed position to the receiving conveyor.

9. Apparatus as claimed in claim 1 in which said receiving conveyor is movable toward and away from said cradle and has a variable speed drive for adjusting the conveyor speed.

10. Apparatus for feeding sheets to a receiving conveyor comprising: support means for centering and supporting the stack in upright position, a cradle for the stack formed by spaced, generally L-shaped members, spaced stanchion members for pivotally supporting said cradle on a horizontal pivotal axis intermediate the ends of one set of the legs of the L-shaped members, the other set of legs carrying conveying means therebetween, means for pivoting the cradle about said axis between a load position in which said conveying means and said other set of legs are horizontal and receive the stack moving horizontally from said supporting means, the stack entering between said one set of legs positioned vertically, and a feed position in which said one set of legs is horizontal, and load support bars moved laterally into the space between said one set of legs of said cradle prior to pivotal movement of the cradle toward said feed position.

* * * * *